United States Patent [19]

Freedman et al.

[11] 4,324,254

[45] Apr. 13, 1982

[54] BRASSIERE HAVING A BOTTOM STRETCH BAND

[75] Inventors: Murray Freedman, Floral Park, N.Y.; Arthur E. Vale, 30 E. 71st St., New York, N.Y. 10021; Peter R. Vale, New York, N.Y.

[73] Assignee: Arthur E. Vale, New York, N.Y.

[21] Appl. No.: 64,620

[22] Filed: Aug. 7, 1979

Related U.S. Application Data

[63] Continuation of Ser. No. 783,530, Apr. 1, 1977, abandoned.

[51] Int. Cl.[3] ..... A41C 3/00

[52] U.S. Cl. ..... 128/494; 128/510

[58] Field of Search ..... 128/494, 489, 498, 510, 128/425

[56] References Cited

U.S. PATENT DOCUMENTS

| | | | |
|---|---|---|---|
| 2,881,764 | 4/1959 | Verreault | 128/494 |
| 3,380,454 | 4/1968 | Hoelscher | 128/510 |
| 3,817,255 | 6/1974 | Lo Cascio | 128/484 |

*Primary Examiner*—Doris L. Troutman

*Attorney, Agent, or Firm*—Blum, Kaplan, Friedman, Silberman and Beran

[57] ABSTRACT

A brassiere which has a pair of cups, opposed side portions extending laterally from these cups and a pair of back portions extending from the side portions also has along lower regions of the cups, side portions and back portions and elongated continuous stretch band which is in a stretched condition extending around the body of the wearer, when the brassiere is worn. This stretch band serves to anchor the brassiere to the body of the wearer so as to oppose undesirable displacement of the brassiere during wearing thereof.

4 Claims, 4 Drawing Figures

BRASSIERE HAVING A BOTTOM STRETCH BAND

This is a continuation, of application Ser. No. 783,530, filed Apr. 1, 1977.

BACKGROUND OF THE INVENTION

The present invention relates to brassieres.

While many different types of brassieres are presently available, up the present time all of the known brassieres suffer from certain drawbacks. Thus, while a brassiere should give the wearer the capability of holding the breasts in place, at the same time the brassiere should give to the wearer considerable comfort and freedom of movement.

However, it has been found from experience that with the conventional brassieres there is an unavoidable creation of considerable discomfort due to various types of body movements carried out by the wearer of the conventional brassieres. Thus, as a result of arm movements such as upward or lateral arm movements, conventional brassieres unavoidably slip with respect to the body, as a result of certain types of body movements, so that conventional brassieres unavoidably ride upwardly along the body or slip laterally along the body. The result is that the lower edge region of a conventional brassiere does not remain at the region of the location where it was initially placed. Thus, conventional brassieres unavoidably creep up beneath the breasts and shirt laterally along the lower portions of the breasts, or a combination of these shifting movements take place, thus creating a considerable amount of discomfort and preventing the conventional brassieres from fulfilling their intended functions.

SUMMARY OF THE INVENTION

It is accordingly a primary object of the present invention to provide a brassiere which will avoid the above drawbacks.

Thus, it is an object of the present invention to provide a brassiere with the capability of remaining at its lower portion substantially at the location in which this lower portion was initially situated, even though the wearer of the brassiere carries out all types of body and arm movements.

At the same time, it is an object of the present invention to provide a brassiere which will, while fulfilling the above objects, nevertheless give the wearer of the brassiere a considerable amount of freedom of movement and considerable comfort, while still maintaining the breasts relatively in place.

It is moreover an object of the present invention to provide a brassiere which can achieve the above objects while at the same time being relatively inexpensive and creating no particular discomfort to the skin which is engaged by the brassiere.

In accordance with the invention the brassiere has a pair of cups, opposed side portions connected to and extending laterally from the cups, with the latter being situated between these side portions, and a pair of back portions which respectively extend from the side portions and terminate in free ends. A pair of shoulder straps extend from upper parts of the back portions to upper parts of the cups. A pair of fastener portions are fixed to the free end of the back portions and form a releasable fastener means for fastening the brassiere on the wearer at the back of the wearer. The cups as well as the side and back portions all have lower regions distributed along the bottom of the brassiere. In accordance with the particular feature of the invention there is an elongated continuous stretch band which is fixed to and extends continuously along the lower regions of the cups as well as the side and back portions, this stretch band terminating in free ends which are respectively fixed to the fastener portions. Thus the stretch band is in a stretched condition when the brassiere is worn with the fastener portions attached to each other. As a result of this construction, the stretch band serves to anchor the brassiere to the body of the wearer so as to oppose undesirable displacement of the brassiere due to lateral or vertical movements of the body, or combinations of such movements.

BRIEF DESCRIPTION OF DRAWINGS

The invention is illustrated by way of example in the accompanying drawings which form part of this application and in which.

DESCRIPTION OF A PREFERRED EMBODIMENT

Figure 1:
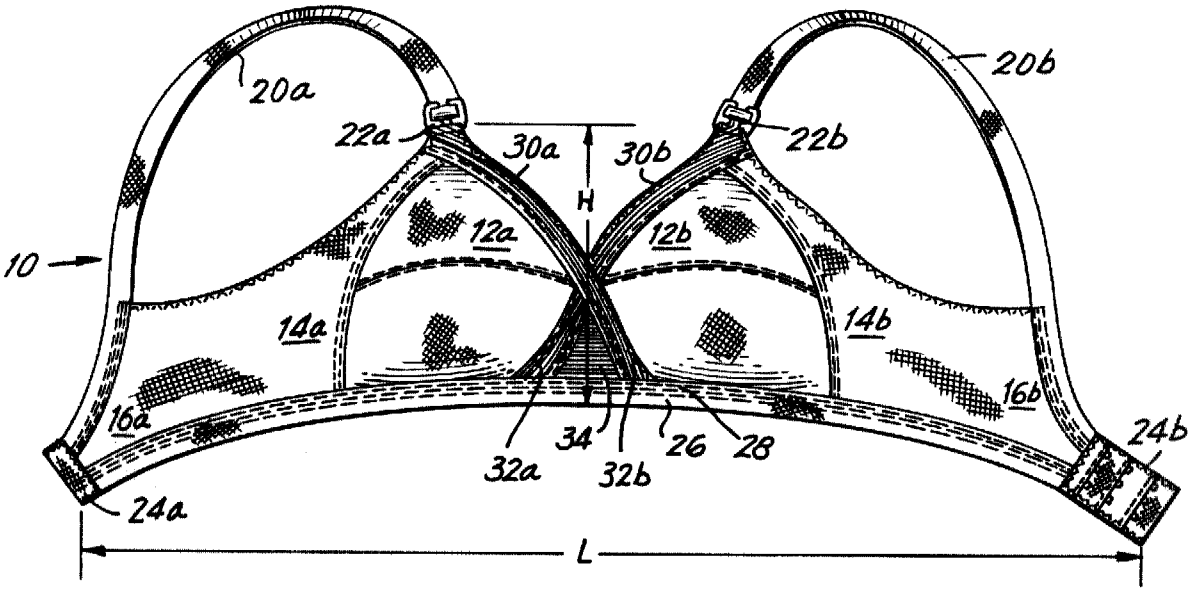
FIG. 1 shows a brassiere of the invention in a front elevation view with the rear portions of the brassiere extending outwardly from the side portions thereof so as to more clearly illustrate the details of the brassiere of the invention.

Referring now to FIG. 1, the brassiere 10 of the invention illustrated therein includes a pair of cups **12*a* and 12*b* which have, respectively, outer side edge regions fixed, as by suitable stitching, to stretchable side portions 14*a* and 14*b*, respectively. These stretchable side portions form extensions of and are integral with a pair of stretchable back portions 16*a* and 16*b* which normally are situated at the back of the wearer but which are illustrated in FIG. 1 extending laterally beyond the side portions 14*a* and 14*b*, so as to more clearly illustrate the structure of the invention. The brassiere also includes a pair of shoulder straps 20*a* and 20*b* respectively fixed to and extending from upper parts of the back portions 16*a* and 16*b* and also being adjustably connected to upper parts of the cups 12*a* and 12*b*, by way of known clips 22*a* and 22*b***, these clips being permanently connected with the upper parts of the cups and having portions through which end regions of the shoulder straps are looped so as to be fixed to the clips in an adjustable manner as is well known.

A pair of fastener portions **24*a* and 24*b* are respectively fixed to free ends of the back portions 16*a* and 16*b*, these fastener portions forming a fastener means for releasably fastening the brassiere on the wearer at the back of the wearer. Thus the fastener portion 24*a* carries at its side which is not visible in FIG. 1 hooks to be received in a selected one of a plurality of rows of eyes of the fastener portion 24*b***, so that in this well known manner it is possible to provide an adjustable fastener means for releasably fastening the brassieres on the body of the wearer.

The cups 12*a* and 12*b*, as well as the side portions 14*a*, 14*b* and back portions 16*a*, 16*b*, all have lower regions to which, in accordance with the invention, an elongated continuous stretch band 26 is fixed. This elongated continuous stretch band is made of any well known longitudinally stretchable ribbon-type of sheet material, and it will be seen from FIG. 1 that the stretch band 26 extends continuously along the lower regions of the cups as well as the side and back portions. The stretch band 26 terminates in a pair of free ends which are respectively fixed to the fastener portion 24*a* and 24*b* as illustrated.

Figure 4:
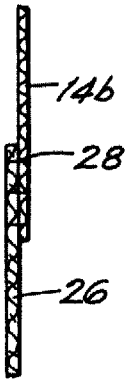
FIG. 4 is a fragmentary section taken along line 4—4 of FIG. 3 in the direction of the arrows and showing at an enlarged scale, as compared to FIG. 3, how the stretch band of the invention is fixed to the brassiere.

FIG. 4 illustrates in particular how the stretch band 26 is fixed to the remainder of the brassiere. Thus, the stretch band 26 has an upper edge region which overlaps a lower edge region of the cups, side, and back portions, the stretch band 26 being shown in FIG. 4 at a part thereof which overlaps a part of the side portion 14*b*, although it is to be understood that the same construction will be found along the entire bottom of the brassiere. Thus, the stretch band 26 where it overlaps the bottom region of the brassiere is, for example, stitched to the various parts distributed along the bottom of the brassiere by lines of stitching 28, thus leaving along the bottom of the brassiere a continuous uninterrupted portion of the band 26 which is free to stretch and contract. Of course the side portions 14*a*, 14*b* and back portions 16*a*, 16*b*, are also made of a stretchable elastic sheet material so that these portions of the brassiere can stretch and contract together with the stretch band 26.

The particular brassiere which is illustrated is of a type similar to that which is shown in U.S. Pat. No. 3,545,445. Thus, the cups 12*a* and 12*b* respectively have not only the outer side edge regions which are respectively fixed with the side portions 14*a* and 14*b* but also inner side edge regions which are adjacent each other. These inner side edge regions of the cups have upper edge sections 30*a* and 30*b* which converge downwardly toward each other and lower edge sections 32*a* and 32*b* which diverge downwardly away from each other. The upper edge section 30*a* of the cup 12*a* forms a continuation of the lower edge section 32*b* of the cup 12*b*, while the upper edge section 30*b* of the cup 12*b* forms a continuation of a lower edge section 32*a* of the cup 12*a*, and these continuous edge sections are made of an elastic stretchable material. It will be noted that the bottom ends of these edge sections are fixed also to the stretch band 26. These continuous edge sections of the inner side regions of the cups of course cross each other as illustrated in the drawing, and at the region where they cross each other they are separate from each other, in the manner shown in greater detail in the above U.S. Pat. No. 3,545,445. As a result of this feature while the breasts are maintained firmly in place, nevertheless there is a considerable freedom of movement and considerable comfort.

The illustrated brassiere 10 also includes a substantially triangular body 34 of stretchable sheet material. This body 34 is stitched to the edge sections 32*a* and 32*b*, while extending therebetween. This body of sheet material 34 has a lower region which is also stitched to the stretch band 26.

Thus, while the above-described brassiere will achieve all of the advantages of the brassiere as shown in U.S. Pat. No. 3,545,445, it will also provide additional advantages as is apparent from a comparison of FIG. 1 with FIGS. 2 and 3. Thus, the stretch band 26 of the brassiere of the invention will serve reliably to anchor the brassiere to the body of the wearer, keeping the breasts in place when the wearer moves, bends, or raises her arms.

Thus, when with a conventional brassiere the wearer throws her shoulders back, the tendency is for the cups to move apart from each other, thus causing the upper parts of the cups also to move apart from each other with the result that a conventional brassiere necessarily yields in such a way that the lower part of such a conventional brassiere moves upwardly. Of course, if the wearer of a conventional brassiere raises her arms, then also the entire brassiere will ride upwardly on the body of wearer. When under these conditions the wearer of a conventional brassiere returns the body to its normal position, the conventional brassiere does not return to the position from which it has been displaced, so that the brassiere stays in the position to which it has slipped upwardly, with the result that considerable discomfort is encountered and the brassiere gathers together beneath the breasts at a location displaced upwardly from its initial location.

Figure 2:
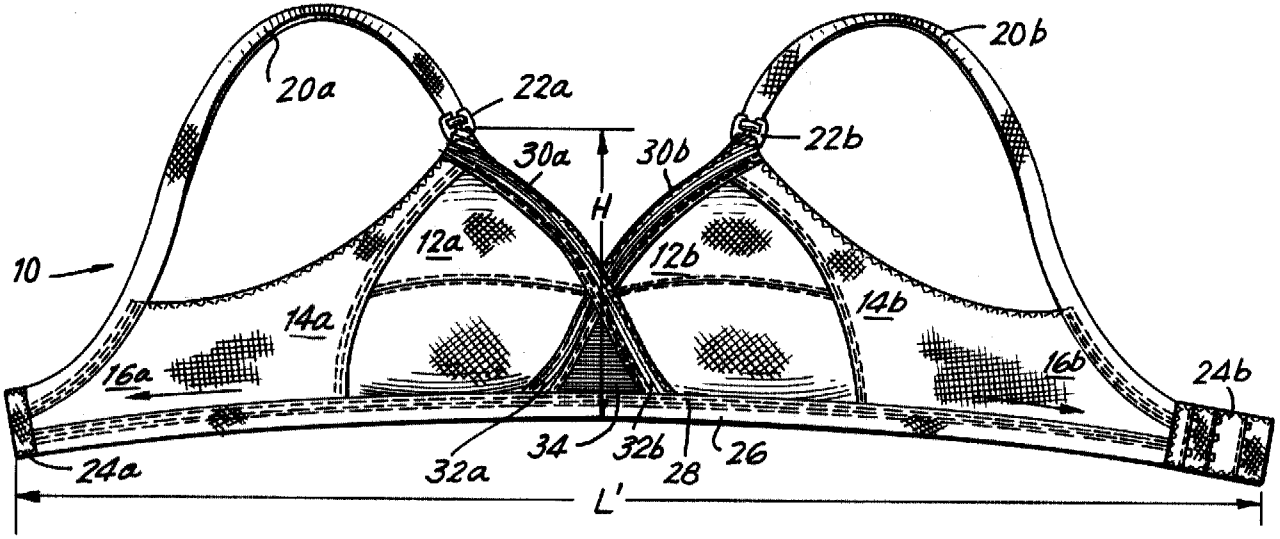
FIG. 2 shows the brassiere of FIG. 1 in a condition where the brassiere has been laterally stretched beyond the condition thereof shown in FIG. 1.

In contrast, with the brassiere of the invention if body movements such as throwing back of the shoulders tend to stretch the brassiere horizontally at its front part, the stretch band 26 will respond by stretching so as to assume, for example, a condition as illustrated in FIG. 2 where the stretch band has become elongated and further stretched to provide between the fastener portions the distance L' which is greater than the distance L shown in FIG. 1. Thus, as such stretching takes place the stretch band of the invention grips the body with a greater force and opposes any tendency of the brassiere to ride up the body of the wearer while at the same time giving the brassiere the capability of contracting back to its condition shown in FIG. 1 when the wearer resumes the normal body position.

Figure 3:
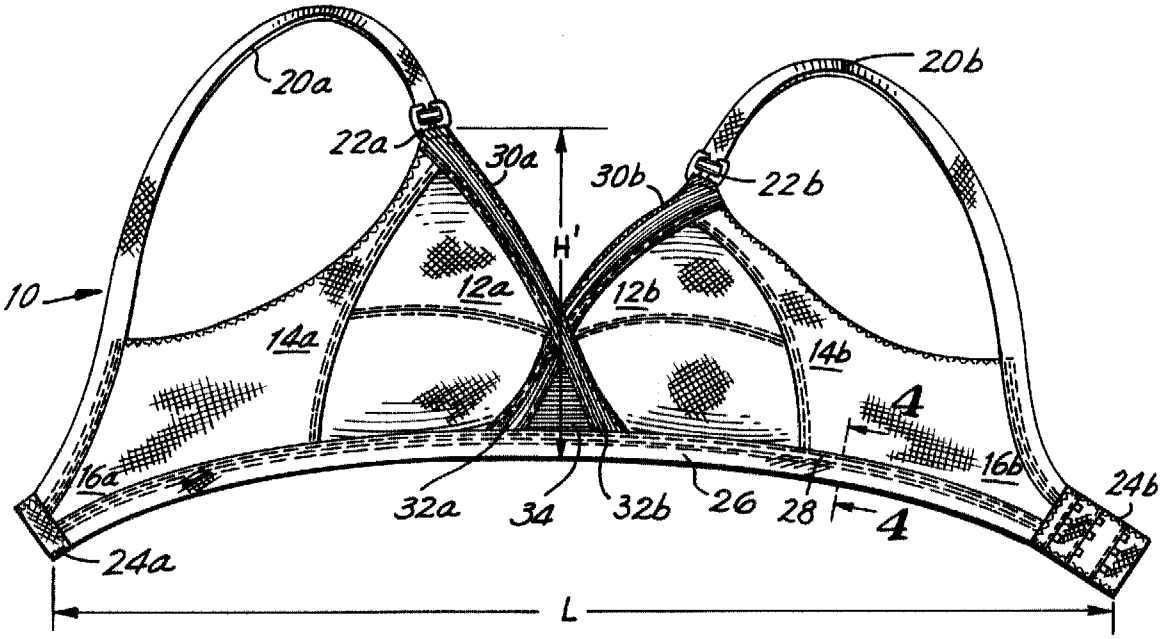
FIG. 3 illustrates the brassiere of FIG. 1 in a condition where the brassiere has been vertically stretched behond the condition thereof shown in FIG. 1.

If the wearer should, for example, raise her arms, then a condition as shown in FIG. 3 will be provided. Thus, it will be noted in FIG. 3 that the distance H' from the tops of the cups to the bottom edge of the stretch band is greater than the distance H indicated in FIG. 1. Thus in this case also because of the elastic gripping of the body by the stretch band, the stretch band 26 will oppose any tendency of the brassiere to ride upwardly along the body, and instead it is the upper regions of the side portions 14*a*, particularly at their narrow parts which extend along the upper outer side edge regions of the cup which yield, the bottom of the brassiere remaining in a substantially unchanged position and at its initial location, as is apparent from a comparison of FIGS. 1 and 3. Thus, in this case also when the shoulders are lowered in response to downward movement of the arms, when the wearer resumes a normal position, the bottom of the brassier has not shifted from its initial position since it was retained in this position by the elastic stretch band 26 of the invention. Instead it is the upper elastic side portions 14*a* and 14*b* which contract while the brassiere returns to its initial condition. Of course part of this stretching to provide the condition illustrated in FIG. 3 is also taken up by the elastic back portion 16*a* and 16*b*. However, the important feature of the invention is that the continuous stretch band 26 serves to maintain the bottom of the brassiere in a substantially unchanged location irrespective of movements of the body which might result in conditions as illustrated in FIGS. 2 and 3 or in combinations of the movements which might result in combinations of these conditions. Thus if the wearer raises only one arm or in combination with raising one arm should twist the body about the waist, or if any other movements, such as bending movements are made either by themselves or in combination with other movements, nevertheless the brassiere of the invention will effectively remain substantially at its initial location so as to avoid any possible discomfort which might result from riding up of the brassiere.

It is particularly to be noted that the elastic stretch band 26 of the invention is a relatively inexpensive component which need only be continuously stitched to the lower part of the brassiere, so that the stretch band of the invention can be joined to the remainder of the brassiere at a very low cost. Thus from the standpoint of materials as well as labor the cost of the brassiere is hardly increased by providing the brassiere with the structure of the invention.

Furthermore, as is particularly apparent from FIG. 4, when the brassiere is worn the stretch band 26 will create no particular discomfort particularly at the skin of the wearer.

Of course the stretch band 26 of the brassiere of the invention need not necessarily be used only with a brassiere of the type illustrated and shown in the above U.S. Pat. No. 3,545,445. While the stretch band of the invention does indeed present certain advantages when used with this particular type of brassiere, because in effect the portion of the stretch band 26 extending to the right in FIG. 1 beyond the edge section **32*b* forms an extension of the latter, while the portion of the stretch band extending to the left beyond the edge section 32*a* forms an extension of this edge section, nevertheless the stretch band of the invention can be used with many different types of brassieres, even those which do not necessarily have the details of the particular brassiere shown in the drawings. It is preferred, however, to use the stretch band of the invention with this particular type of brassiere because with this particular construction when the upper edge section 30*a* is stretched, this stretching is transmitted without interruption from the section 30*a* along the section 32*b* and then along the lower right portion of the stretch band 26 in FIG. 1 where it extends to the right beyond the lower edge section 32*b* of the right cup 12*b* of FIG. 1. In the same way stretching of the upper edge section 30*b* will be transmitted along the lower edge section 32*a* of the left cup of FIG. 1 from this lower edge section 32*a* along the part of the stretch band 26 which extends from this lower edge section 32*a* all the way up to the fastener portion 24*a*. Thus with this particular type of brassiere the stretch band 26** is of particular advantage because it permits the independent stretching of the inner edge sections of the cups to be transmitted continuously all the way up to the fastener portions.

What is claimed is:

1. A brassiere having a pair of cups, opposed side portions connected to and extending laterally from said cups with the latter being situated between said side portions, and a pair of back portions respectively extending from said side portions and terminating in free ends, a pair of stretchable shoulder straps extending from upper parts of said back portions to upper parts of said cups, and a pair of fastener portions fixed to said free ends of said back portions and forming a releasable fastener means for fastening the brassiere on the wearer at the back of the wearer, said cups as well as said side and back portions all having lower regions distributed along the bottom of the brassiere, the improvement comprising an elongated continuous stretch band fixed to and extending continuously along said lower regions of said cups and side and back portions and terminating in free ends respectively fixed to said fastener portions, said stretch band being in a stretched condition when the brassiere is worn with said fastener portions attached to each other, whereby said stretch band serves to anchor the brassiere to the body of the wearer to oppose undesirable displacement of the brassiere due to lateral or vertical movements of the body, or combinations of such movements, said cups respectively having outer side edge regions connected with said opposed side portions, respectively, and inner side edge regions situated adjacent each other, said inner side edge regions of said cups respectively having upper elongated side sections which converge downwardly toward each other and lower elongated edge sections which diverge downwardly away from each other and terminate in lower ends spaced apart from each other and fixed to said stretch band, the upper edge section of one cup forming a continuation of the lower edge section of the other cup, and the upper edge section of the other cup forming a continuation of the lower edge section of said one cup, said edge sections at said inner side edge regions of said cups being stretchable along their entire lengths, and said edge sections at said inner side edge regions of said cups crossing each other at the intersection between said downwardly converging and downwardly diverging parts thereof, the intersection spaced apart from said stretch band, said edge sections where they cross each other being at least partly separate from each other and a substantially trinagular body of stretchable sheet material situated between and fixed to the downwardly diverging lower edge sections of said cups to afford independent stretching of each of the continuous edge sections, the upper elongated stretchable edge sections which converge downwardly toward each other respectively having upper ends connected to said stretchable shoulder straps at said upper parts of said cups, so that an upward pull at either shoulder strap will be transmitted diagonally downwardly across the front of the brassiere along a continuous stretchable edge section to the stretch band toward that side of the body which is opposite from the side where the upwardly pulled shoulder strap is located.

2. The combination of claim 1 and wherein said side and back portions are made of a stretchable sheet material capable of stretching and contracting together with said stretch band.

3. The combination of claim 1 and wherein said shoulder straps include elongated portions fixed to and extending along upper edge regions of said back portions up to said fastener portions where said shoulder straps terminate in free ends respectively fixed to said fastener portions.

4. A brassiere comprising:

an elongated continuous stretch band extending along the lower region of the brassiere;

a pair of cups fixed to said stretch band;

a pair of stretchable side and back portions attached to the associated cup and stretch band;

a pair of fastener portions attached to the associated side and back portions;

a pair of stretchable shoulder straps extending from the upper region of an associated cup to the rear of the associated side and back portion;

a pair of stretchable inner facing cup edges, including upper regions converging downwardly towards each other and lower regions diverging downwardly away from each other and fixed to said stretch band at positions spaced apart from each other, the upper region of the edge of one cup being a continuation of the lower region of the edge of the other cup, said edges overlapping at an intersection spaced apart from said stretch band, said edges being at least partially separate from each other at said intersection; and a substantially triangular body of stretchable sheet material situated between the intersection of the lower region of said edges and fixed to the lower regions of the cup edges and stretch band.

* * * * *